US012780372B2

(12) United States Patent
Ledden et al.

(10) Patent No.: US 12,780,372 B2
(45) Date of Patent: Nov. 3, 2026

(54) SYSTEMS AND METHODS FOR PLANNING CONSUMPTION OF POWER BY DEVICES ABOARD A MARINE VESSEL

(71) Applicant: Brunswick Corporation, Mettawa, IL (US)

(72) Inventors: John T. Ledden, Edgewater, FL (US); Robert P. Macias, Merritt Island, FL (US)

(73) Assignee: Brunswick Corporation, Mettawa, IL (US)

( * ) Notice: Subject to any disclaimer, the term of this patent is extended or adjusted under 35 U.S.C. 154(b) by 732 days.

(21) Appl. No.: 16/923,866

(22) Filed: Jul. 8, 2020

(65) Prior Publication Data

US 2022/0009605 A1 Jan. 13, 2022

(51) Int. Cl.

| | |
|---|---|
| ***B63B 79/00*** | (2020.01) |
| ***B63B 79/10*** | (2020.01) |
| ***B63B 79/40*** | (2020.01) |

(52) U.S. Cl.

CPC ..... *B63B 79/40* (2020.01); *B63B 79/10* (2020.01)

(58) Field of Classification Search

CPC ..... B63B 79/40; B63B 79/10; H02J 2203/10; H02J 2310/42; H02J 3/003; H02J 3/14;

(Continued)

(56) References Cited

U.S. PATENT DOCUMENTS 6,342,775 B1 1/2002 Sleder, Sr.
6,652,330 B1 * 11/2003 Wasilewski ..... H02J 1/14 440/2

(Continued)

FOREIGN PATENT DOCUMENTS

CN 107534300 A * 1/2018 ..... B60L 50/15
CN 113938959 A * 1/2022 ..... H04W 36/0061

(Continued)

OTHER PUBLICATIONS

JP2016068892A_ShipNavigationSystemAndShipNavigationSupportingMethod (Year: 2016).*

(Continued)

*Primary Examiner* — Ramon A. Mercado
*Assistant Examiner* — Shaheda Hoque
(74) *Attorney, Agent, or Firm* — Andrus Intellectual Property Law, LLP

(57) ABSTRACT

A method for planning consumption of power by devices onboard a marine vessel from a power source having a finite capacity. The method includes storing a usage model within a memory system, where the usage model includes an amount of the power consumed by each of the devices over a time period. The method further includes receiving a usage plan for operating the marine vessel while the power source is limited to the finite capacity. The method further includes analyzing with a control system the usage plan in view of the usage model and generating a projected performance of the power source, wherein the projected performance indicates the ability of the power source to supply the power needed by the devices while operating the marine vessel according to the usage plan.

19 Claims, 4 Drawing Sheets

(58) Field of Classification Search
CPC ..... G06F 30/15; G06F 30/20; G06Q 10/04; G06Q 10/0631; G06Q 50/06
See application file for complete search history.

(56) References Cited

U.S. PATENT DOCUMENTS

| | | | | |
|---|---|---|---|---|
| 7,218,118 | B1 * | 5/2007 | Gonring | G01R 31/3647 320/132 |
| 8,043,132 | B1 | 10/2011 | Wyant | |
| 8,608,521 | B1 | 12/2013 | Snyder et al. | |
| 8,725,329 | B1 | 5/2014 | Snyder et al. | |
| 8,836,544 | B1 | 9/2014 | Balogh | |
| 9,054,555 | B1 | 6/2015 | Ward | |
| 9,362,838 | B1 | 6/2016 | Balogh et al. | |
| 9,533,747 | B2 * | 1/2017 | Arbuckle | B63H 21/20 |
| 9,739,624 | B2 | 8/2017 | Rajagopalan et al. | |
| 10,295,355 | B2 | 5/2019 | Baglino et al. | |
| 10,573,098 | B2 | 2/2020 | Mash | |
| 10,650,621 | B1 | 5/2020 | King | |
| 2010/0019718 | A1 * | 1/2010 | Salasoo | B60L 58/15 320/128 |
| 2010/0106350 | A1 * | 4/2010 | Alston | B63H 23/24 73/290 R |
| 2010/0168942 | A1 * | 7/2010 | Noffsinger | G01C 21/20 715/764 |
| 2011/0320073 | A1 * | 12/2011 | Rasanen | G01C 21/203 701/21 |
| 2012/0197448 | A1 * | 8/2012 | Shin | G06Q 10/06 700/286 |
| 2012/0277941 | A1 * | 11/2012 | Noffsinger | G08G 3/00 701/21 |
| 2012/0316717 | A1 * | 12/2012 | Daum | B60L 55/00 701/22 |
| 2013/0184901 | A1 * | 7/2013 | Wall | B60W 50/0097 701/3 |
| 2013/0241485 | A1 | 9/2013 | Snyder | |
| 2013/0261914 | A1 * | 10/2013 | Ingram | B60W 30/188 701/423 |
| 2013/0338845 | A1 * | 12/2013 | Jerphagnon | G06F 1/26 700/297 |
| 2014/0330460 | A1 * | 11/2014 | Schoonmaker | B60L 9/00 701/19 |
| 2014/0336853 | A1 * | 11/2014 | Bradenham | B63B 49/00 701/21 |
| 2015/0149136 | A1 * | 5/2015 | Tervo | B63B 79/10 703/8 |
| 2017/0054296 | A1 * | 2/2017 | Daniel | F03D 9/25 |
| 2017/0176195 | A1 | 6/2017 | Rajagopalan et al. | |
| 2018/0041072 | A1 * | 2/2018 | Clifton | H02J 3/32 |
| 2018/0062388 | A1 * | 3/2018 | Mathiesen | H02J 3/28 |
| 2018/0186357 | A1 * | 7/2018 | Deshpande | B60W 30/188 |
| 2018/0327052 | A1 * | 11/2018 | Van Miert | B63B 71/00 |
| 2020/0047628 | A1 * | 2/2020 | Degand | B60W 50/0097 |
| 2020/0273268 | A1 * | 8/2020 | Bhattacharyya | G06Q 10/06315 |
| 2021/0192630 | A1 * | 6/2021 | Hakimi-Boushehri | G06Q 40/08 |
| 2021/0293863 | A1 * | 9/2021 | Micali | G05B 15/02 |
| 2022/0344941 | A1 * | 10/2022 | Griffith | H02J 7/0063 |
| 2023/0219675 | A1 * | 7/2023 | Janeczko | B60L 58/12 440/6 |

FOREIGN PATENT DOCUMENTS

| | | | | |
|---|---|---|---|---|
| CN | 110794671 | B * | 12/2022 | G05B 13/024 |
| EP | 3273568 | B1 * | 5/2023 | B60L 58/13 |
| EP | 3980716 | B1 * | 1/2024 | G01C 21/203 |
| GB | 2569351 | A | 6/2019 | |
| JP | 2014127045 | A * | 7/2014 | |
| JP | 2016068892 | A * | 5/2016 | |
| JP | 5986920 | B2 * | 9/2016 | |
| KR | 20210120325 | A * | 10/2021 | B63J 2/02 |
| WO | WO-2010077554 | A1 * | 7/2010 | B61L 3/006 |
| WO | 2011079870 | A1 | 7/2011 | |
| WO | WO-2016110693 | A1 * | 7/2016 | G01C 21/203 |

OTHER PUBLICATIONS

JP2016068892A_ShipNavigationSystemAndShipNavigationSupportingMethod_Drawings (Year: 2016).*
W. Xu and M. Dong, "Tracking energy consumptions of home appliances using electrical signature data," 2012 IEEE Power and Energy Society General Meeting, San Diego, CA, USA, 2012, pp. 1-5 (Year: 2012).*
CN110794671B (Year: 2022).*
KR20210120325A (Year: 2021).*
D. Kumar and F. Zare, "A Comprehensive Review of Maritime Microgrids: System Architectures, Energy Efficiency, Power Quality, and Regulations," in IEEE Access, vol. 7, pp. 67249-67277, 2019 (Year: 2019).*
Extended European Search Report for corresponding European Application No. 21172689.8 filed May 7, 2021.
Examination Report for corresponding European Patent Application No. 21172689.8 dated Oct. 6, 2023.
Second Office Action issued in Chinese Patent Application No. 202110620151.7, dated Jun. 3, 2026.

* cited by examiner

| DEVICES (412) | DURATION (414) | POWER USED (416) | % CAP. (418) |
|---|---|---|---|
| -DEVICE A (WATER HEATER) | 2 HRS | 4 KWH | 3.2% |
| -DEVICE B (SHOWER LIGHT) | 25 MIN | 0.1 KWH | 0.1% |
| -DEVICE C (AIR CONDITIONING) | 8 HRS | 40 KWH | 32.0% |
| -DEVICE D (WATER MAKER) | 1 HR | 0.5 KWH | 0.4% |
| -DEVICE E (OUTDOOR ACCENT LIGHTS) | 15 HRS | 4 KWH | 3.2% |
| -DEVICE F (GPS) | 24 HRS | 2.4 KWH | 1.9% |
| -DEVICE G (AUDIO SYSTEM) | 10 HRS | 5 KWH | 4.0% |
| -DEVICE H (ELEC. DRIVE – PORT) | 6 HRS | 6 KWH | 4.8% |
| -DEVICE I (ELEC. DRIVE – STRBRD) | 6 HRS | 6.4 KWH | 5.1% |
| - … | | | |
| - (OTHERS) … | | 20 KWH | 16.0% |
| TOTALS | N/A | 88.4 KWH | 70.7% |

*ASSUMING 125KWH POWER SOURCE CAPACITY (410)

(420)

| DEVICE A: POWER USED BY TIME RANGE | |
|---|---|
| -6:00AM – 9:59AM: | 0.5KWH |
| -10:00AM – 7:59PM: | 0.5KWH |
| -8:00PM – 9:59PM: | 1KWH |
| -10:00PM – 5:59AM: | 2KWH |

(422) (424)

| DEVICES (432) | DURATION (434) | POWER GEN. (436) | % CAP. (438) |
|---|---|---|---|
| -ENGINE ALTERNATOR | 4 HRS | 10KWH | 8% |
| -EXTERNAL GENERATOR | 1 HR | 1KWH | 0.8% |
| -WIND TURBINE | 24 HRS | 1.4KWH | 1.1% |
| -SOLAR PANELS | 16 HRS | 1.9KWH | 1.5% |

(430)

(400)

*FIG. 4*

SYSTEMS AND METHODS FOR PLANNING CONSUMPTION OF POWER BY DEVICES ABOARD A MARINE VESSEL

FIELD

The present disclosure generally relates to systems and methods for planning consumption of power by devices aboard a marine vessel, particularly from a power source having a finite capacity.

BACKGROUND

U.S. Pat. No. 6,652,330 discloses a method for controlling the electrical system of a marine vessel that comprises the steps of measuring a battery potential, comparing the battery potential to a threshold voltage magnitude, and then disconnecting one or more of a plurality of electrical power consuming devices when the voltage potential is less than the threshold voltage magnitude. This is done to avoid the deleterious condition wherein an engine of the marine vessel is operating at idle speed and attempting to charge the battery while a plurality of electrical power consuming devices are operating and drawing sufficient current from the alternator to prevent the proper charging of the battery. In these circumstances, the battery potential can actually be depleted as the battery attempts to provide the additional required electrical current for the loads.

U.S. Pat. No. 6,342,775 discloses a battery switching circuit that provides a mechanism by which a plurality of electrical storage batteries can be alternatively connected in parallel or series based on the position of a manually controlled joystick of a marine positioning and maneuvering system. When the joystick is in a neutral position in which no docking motion is demanded by the marine vessel operator, the storage batteries are connected in parallel so that they can benefit from charging by an alternator or generator associated with an internal combustion engine. If the joystick is moved out of its neutral position, the batteries are immediately connected in series to provide power to a plurality of electric motors that are used to drive a plurality of impellers of the docking system.

U.S. Pat. No. 9,533,747 discloses a hybrid propulsion system that has an internal combustion engine and an electric motor that each selectively powers a marine propulsor to propel a marine vessel. A plurality of batteries discharges current to power the motor. A controller is programmed to aggregate the recharge and/or discharge limits of plurality of batteries and then operate the system according to a method that preferably prevents internal fault and disconnection of batteries in the plurality.

U.S. Pat. No. 7,218,118 discloses a method for monitoring the condition of a battery of a marine propulsion system that provides the measuring of a voltage characteristic of the battery, comparing the voltage characteristic to a preselected threshold value, and evaluating the condition of the battery as a function of the relative magnitudes of the voltage characteristic and the threshold value. The voltage characteristic of the battery is measured subsequent to a connection event when a connection relationship between the battery and an electrical load is changed. The electrical load is typically a starter motor which is connected in torque transmitting relation with an internal combustion engine. The voltage characteristic is preferably measured at its minimum value during the inrush current episode immediately prior to cranking the internal combustion engine shaft to start the engine.

The above-noted patents and applications are hereby incorporated by reference herein, in their entireties.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

One embodiment of the present disclosure generally relates to a method for planning consumption of power by devices onboard a marine vessel from a power source having a finite capacity. The method includes storing a usage model within a memory system, where the usage model includes an amount of the power consumed by each of the devices over a time period. The method further includes receiving a usage plan for operating the marine vessel while the power source is limited to the finite capacity. The method further includes analyzing with a control system the usage plan in view of the usage model and generating a projected performance of the power source, wherein the projected performance indicates the ability of the power source to supply the power needed by the devices while operating the marine vessel according to the usage plan.

Another embodiment generally relates to a method for planning consumption of power by devices onboard a marine vessel from a power source having a finite capacity. The method includes storing in a memory system a usage model that includes an amount of the power consumed by each of the devices over a previous time period. The method further includes, during a subsequent time period after the previous time period and after the finite capacity of the power source has been restored, generating with a control panel and based on the usage model a projected performance indicating an ability of the power source to supply the power needed by the devices when operated according to the usage model.

Various other features, objects and advantages of the disclosure will be made apparent from the following description taken together with the drawings.

BRIEF DESCRIPTION OF THE DRAWINGS

The present disclosure is described with reference to the following Figures. The same numbers are used throughout the Figures to reference like features and like components.

FIG. 4 depicts exemplary data stored and executed in conjunction with executing a method such as that depicted in FIG. 3.

DETAILED DESCRIPTION

In the present description, certain terms have been used for brevity, clarity, and understanding. No unnecessary limitations are to be implied therefrom beyond the requirement of the prior art because such terms are used for descriptive purposes only and are intended to be broadly construed. The different systems and methods described herein may be used alone or in combination with other systems and methods. Various equivalents, alternatives, and modifications are possible.

Figure 1:
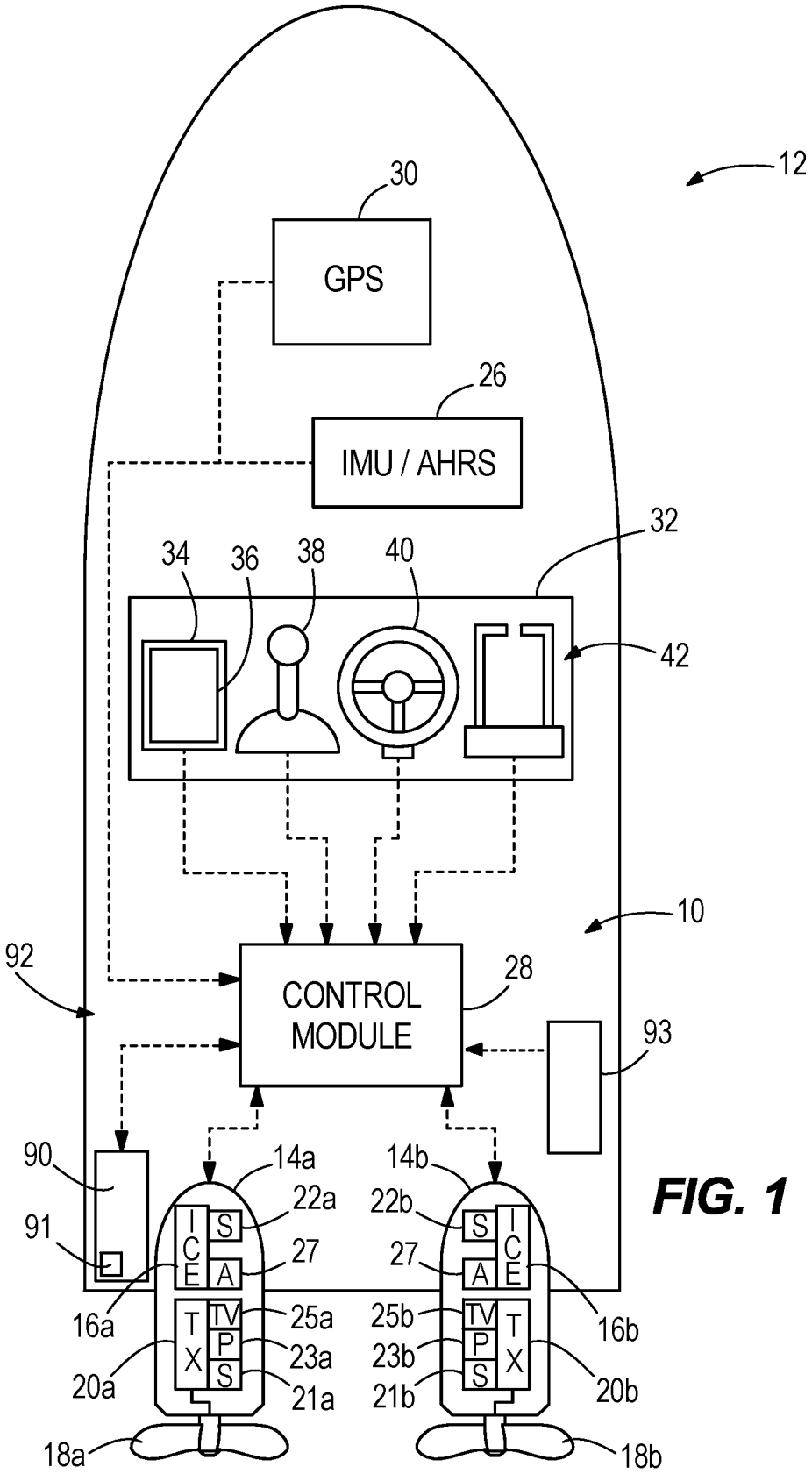
FIG. 1 depicts an exemplary marine vessel including a system for planning consumption of power by devices according to the present disclosure.

FIG. 1 illustrates a marine propulsion system 10 for a marine vessel 12. The marine propulsion system 10 includes two marine propulsion devices 14*a*, 14*b*, but one or more than two marine propulsion devices could instead be provided. The marine propulsion devices 14*a*, 14*b* shown herein are outboard motors, but the marine propulsion devices could instead be inboard motors, stern drives, pod drives, jet drives, etc. Each marine propulsion device 14*a*, 14*b* includes an engine 16*a* or 16*b*. The engines 16*a*, 16*b* shown here are internal combustion engines, which may be, for example, gasoline or diesel engines. Each marine propulsion device 14*a*, 14*b* also includes a propeller 18*a* or 18*b* configured to be coupled in torque-transmitting relationship with a respective engine 16*a* or 16*b*. Such torque-transmitting relationship is more specifically provided by way of a transmission 20*a* or 20*b* configured to transmit torque from a respective engine 16*a* or 16*b* to a respective propeller 18*a* or 18*b*. Each transmission 20*a*, 20*b* is configured to transmit torque from the engine 16*a* or 16*b* to the propeller 18*a* or 18*b* at one of at least a first gear ratio and a second gear ratio, although additional gear ratios such as, for example, third, fourth, fifth, etc. gear ratios could be provided. Alternatively, only a single forward gear ratio may be provided.

The marine propulsion system 10 further includes engine speed sensors 22*a*, 22*b* measuring a speed of a respective engine 16*a*, 16*b*. In one example, the engine speed sensors 22*a*, 22*b* may be shaft rotational speed sensors (e.g., tachometers), which measure a speed of the engine 16*a* or 16*b* in rotations per minute (RPM), as is known to those having ordinary skill in the art. The engine speed is also referenced to as a transmission input speed, as the input shaft of a transmission in certain embodiments is coupled to rotate directly therewith. Each transmission 20*a*, 20*b* includes a transmission output speed (TOS) sensor 21*a*, 21*b* that measures a transmission output speed of the respective transmission 20*a*, 20*b* in RPM. The TOS sensors 21*a*, 21*b* may be of a type similar to that of the engine speed sensors 22*a*, 22*b*. Clutch pressure sensors 23*a*, 23*b* are also provided in connection with the transmissions 20*a*, 20*b*. Clutch pressure sensors 23*a*, 23*b* can be pressure transducers in the hydraulic circuit(s) associated with the clutches of the transmissions 20*a*, 20*b*. Trolling valves 25*a*, 25*b* are also provided for each marine propulsion device 14*a*, 14*b*, and will be described further herein below.

The marine propulsion system 10 also includes a control module 28 in signal communication with the engines 16*a*, 16*b* and the transmissions 20*a*, 20*b*, as well as their associated sensors and valves and other components noted herein below. The control module 28 may also be configured to control the flow of power between components in the marine vessel 12. Among these components is a power source 90, which in certain embodiments includes batteries 91 and/or other energy storage systems in a manner known in the art. The power source 90 of certain embodiments also includes power management and protection circuitry, such as that discussed in the U.S. patents referenced in the Background section, for example. It will also be recognized that portions of the entirety of the power source 90 may also be combined with or include at least portions of the control module 28 or other components shown in FIG. 1, for example.

In the exemplary embodiment of FIG. 1, an alternator 27 provided with the marine propulsion devices 14*a*, 14*b* generates power via rotation of the engines 16*a*, 16*b* in a manner known in the art. These alternators 27 generate and provide power to the power source 90, such as to charge the batteries 91 or aid in powering any power consuming devices connected thereto.

The control module 28 is programmable and includes a processor and a memory. The control module 28 can be located anywhere in the marine propulsion system 10 and/or located remote from the marine propulsion system 10 and can communicate with various components of the marine vessel 12 via a peripheral interface and wired and/or wireless links, as will be explained further herein below. Although FIG. 1 shows one control module 28, the marine propulsion system 10 can include more than one control module. Portions of the method disclosed herein below can be carried out by a single control module or by several separate control modules. For example, the marine propulsion system 10 can have control modules located at or near a helm 32 of the marine vessel 12 and can also have control module(s) located at or near the marine propulsion devices 14*a*, 14*b*. If more than one control module is provided, each can control operation of a specific device or sub-system on the marine vessel.

In some examples, the control module 28 may include a computing system that includes a processing system, storage system, software, and input/output (I/O) interfaces for communicating with peripheral devices. The systems may be implemented in hardware and/or software that carries out a programmed set of instructions. As used herein, the term "control module" may refer to, be part of, or include an application specific integrated circuit (ASIC); an electronic circuit; a combinational logic circuit; a field programmable gate array (FPGA); a processor (shared, dedicated, or group) that executes code; other suitable components that provide the described functionality; or a combination of some or all of the above, such as in a system-on-chip (SoC). A control module may include memory (shared, dedicated, or group) that stores code executed by the processing system. The term "code" may include software, firmware, and/or microcode, and may refer to programs, routines, functions, classes, and/or objects. The term "shared" means that some or all code from multiple control modules may be executed using a single (shared) processor. In addition, some or all code from multiple control modules may be stored by a single (shared) memory. The term "group" means that some or all code from a single control module may be executed using a group of processors. In addition, some or all code from a single control module may be stored using a group of memories.

The control module 28 communicates with one or more components of the marine propulsion system 10 via the I/O interfaces and a communication link, which can be a wired or wireless link. In one example, the communication link is a controller area network (CAN) bus, but other types of links could be used. It should be noted that the extent of connections of the communication link shown herein is for schematic purposes only, and the communication link in fact provides communication between the control module 28 and each of the peripheral devices noted herein, although not every connection is shown in the drawing for purposes of clarity.

Figure 2:
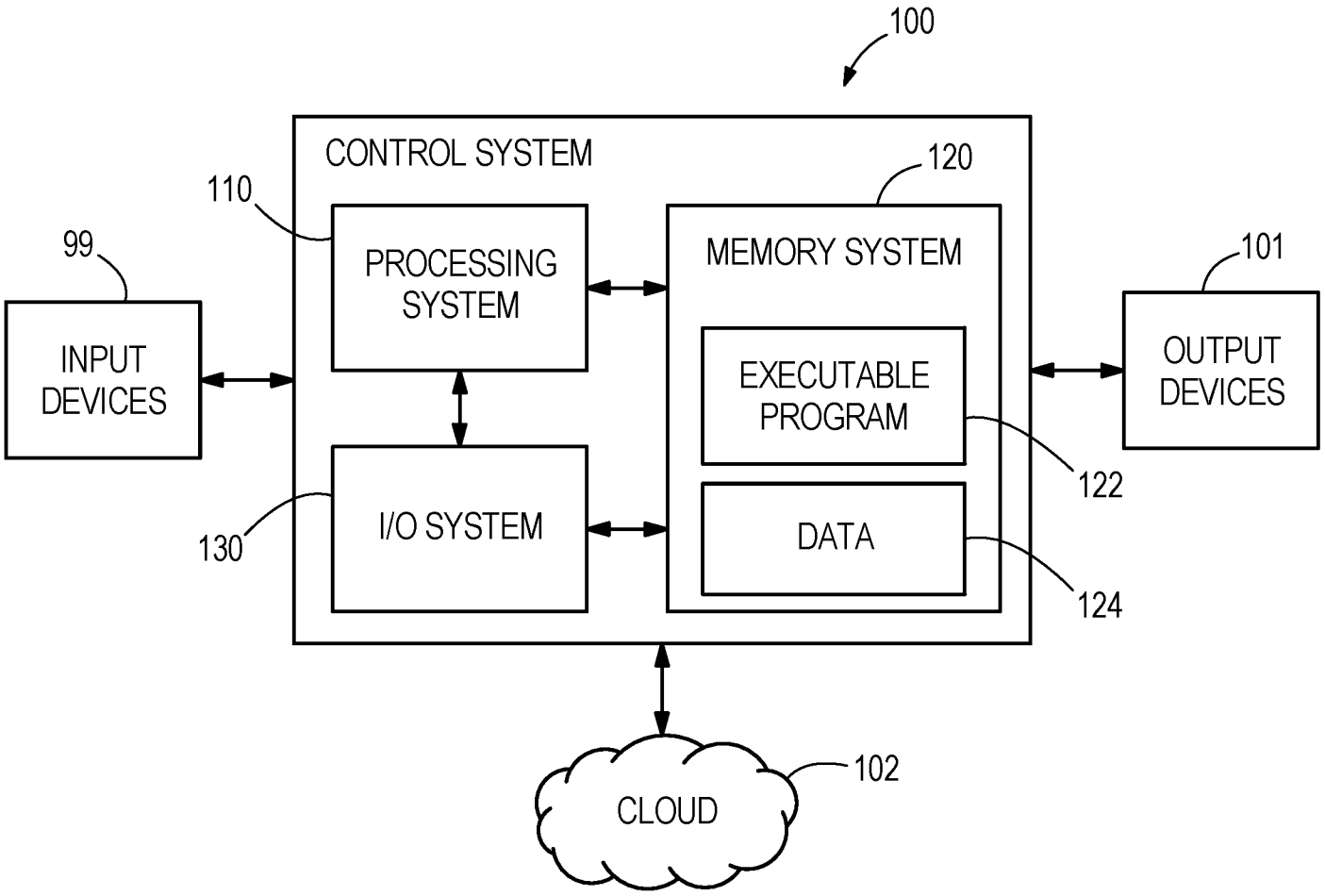
FIG. 2 depicts an exemplary control system such as may be incorporated within the marine vessel of FIG. 1.

An exemplary control system 100 is shown in FIG. 2, which can be used as the control module 28 discussed above. Certain aspects of the present disclosure are described or depicted as functional and/or logical block components or processing steps, which may be performed by any number of hardware, software, and/or firmware components configured to perform the specified functions. For example, certain embodiments employ integrated circuit components, such as memory elements, digital signal processing elements, logic elements, look-up tables, or the like, configured to carry out a variety of functions under the control of one or more processors or other control devices. The connections between functional and logical block components are merely exemplary, which may be direct or indirect, and may follow alternate pathways.

In certain examples, the control system 100 communicates with each of the one or more components of the marine propulsion system 10 via a communication link CL, which can be any wired or wireless link. The control module 100 is capable of receiving information and/or controlling one or more operational characteristics of the marine propulsion system 10 and its various sub-systems by sending and receiving control signals via the communication links CL. In one example, the communication link CL is a controller area network (CAN) bus; however, other types of links could be used. It will be recognized that the extent of connections and the communication links CL may in fact be one or more shared connections, or links, among some or all of the components in the system 1. Moreover, the communication link CL lines are meant only to demonstrate that the various control elements are capable of communicating with one another, and do not represent actual wiring connections between the various elements, nor do they represent the only paths of communication between the elements. Additionally, the marine propulsion system 10 may incorporate various types of communication devices and systems, and thus the illustrated communication links CL may in fact represent various different types of wireless and/or wired data communication systems.

The control system 100 may be a computing system that includes a processing system 110, memory system 120, and input/output (I/O) system 130 for communicating with other devices, such as input devices 99 and output devices 101, either of which may also or alternatively be stored in a cloud 102. The processing system 110 loads and executes an executable program 122 from the memory system 120, accesses data 124 stored within the memory system 120, and directs the marine propulsion system 10 to operate as described in further detail below.

The processing system 110 may be implemented as a single microprocessor or other circuitry, or be distributed across multiple processing devices or sub-systems that cooperate to execute the executable program 122 from the memory system 120. Non-limiting examples of the processing system include general purpose central processing units, application specific processors, and logic devices.

The memory system 120 may comprise any storage media readable by the processing system 110 and capable of storing the executable program 122 and/or data 124. The memory system 120 may be implemented as a single storage device, or be distributed across multiple storage devices or sub-systems that cooperate to store computer readable instructions, data structures, program modules, or other data. The memory system 120 may include volatile and/or non-volatile systems, and may include removable and/or non-removable media implemented in any method or technology for storage of information. The storage media may include non-transitory and/or transitory storage media, including random access memory, read only memory, magnetic discs, optical discs, flash memory, virtual memory, and non-virtual memory, magnetic storage devices, or any other medium which can be used to store information and be accessed by an instruction execution system, for example.

Returning to FIG. 1, the marine propulsion system 10 also includes a global positioning system (GPS) 30 that provides location and speed of the marine vessel 12 to the control module 28. Additionally or alternatively, a vessel speed sensor such as a Pitot tube or a paddle wheel could be provided. The marine propulsion system 10 may also include an inertial measurement unit (IMU) or an attitude and heading reference system (AHRS) 26. An IMU has a solid state, rate gyro electronic compass that indicates the vessel heading and solid state accelerometers and angular rate sensors that sense the vessel's attitude and rate of turn. An AHRS provides 3D orientation of the marine vessel 12 by integrating gyroscopic measurements, accelerometer data, and magnetometer data. The IMU/AHRS could be GPS-enabled, in which case a separate GPS 30 would not be required.

Further, the marine propulsion system 10 includes a number of operator input devices located at the helm 32 of the marine vessel 12. The operator input devices include a multi-functional display device 34 including a user interface 36. The user interface 36 may be an interactive, touch-capable display screen, a keypad, a display screen and keypad combination, a track ball and display screen combination, or any other type of user interface known to those having ordinary skill in the art for communicating with a multi-functional display device 34. A joystick 38 is also provided at the helm 32 and allows an operator of the marine vessel 12 to command the marine vessel 12 to translate or rotate in any number of directions. A steering wheel 40 is provided for providing steering commands to the marine propulsion devices 14*a*, 14*b* or to a rudder, in the event that the marine propulsion devices are not steerable. A throttle lever 42 is also provided for providing thrust commands, including both a magnitude and a direction of thrust, to the control module 28. Here, two throttle levers are shown, each of which can be used to control one of the marine propulsion devices 14*a* or 14*b*, although the two levers can be controlled together as a single lever. Alternatively, a single lever could be provided for controlling both marine propulsion devices 14*a*, 14*b*.

Several of the operator input devices at the helm 32 can be used to input an operator demand on the engines 16*a*, 16*b* to the control module 28, including the user interface 36 of the multi-functional display device 34, the joystick 38, and the throttle lever 42. By way of example, a rotation of the throttle lever 42 in a forward direction away from its neutral, detent position could be interpreted as a value from 0% to 100% operator demand corresponding via an input/output map, such as a look up table, to a position of the throttle valves of the engines 16*a*, 16*b*. For example, the input/output map might dictate that the throttle valves are fully closed when the throttle lever 42 is in the forward, detent position (i.e., 0% demand), and are fully open when the throttle lever 42 is pushed forward to its furthest extent (i.e., 100% demand).

The inventors have recognized problems with the management of power sources having finite capacities, including the inability to effectively plan for consumption of this limited power by devices. The present disclosure will principally refer to planning for consumption of power by devices aboard a marine vessel. However, it will be recognized that the same methods and systems are also applicable to other systems in which a power source has a finite capacity, such as recreational vehicles, electric vehicles, and the like. In the context of modern marine vessels, it is typical that there is a large number of electrical systems onboard, or in other words there are many devices that consume power.

To support these systems there is often a fuel-based generator installed that provides power to the system and also recharges energy storage systems, such as batteries. These marine vessels often include large fuel tanks such that the generators can last a very long time, providing the power necessary to run all onboard devices and maintain a charge in the supplemental batteries, thereby negating the need for closely monitoring energy consumption by any of the devices onboard. It will be recognized that with respect to generators, this may include power generated by an engine and accompanying alternator as previously discussed, and/or the use of external generators 93 (FIG. 1) for producing electricity through the consumption of fuel, such as gasoline. Wind turbines and solar panels may also be used to supplement the power available within a power system among the external generators 93, including to power the devices 412 in real-time, and/or to assist in recharging batteries 91, for example.

However, the inventors have recognized that in systems in which no generator is provided or available for use, instead relying entirely upon batteries, there is a great need for effective monitoring and planning of consumption of the finite capacity within the power source for powering the devices. In the context of a marine vessel embarked on an excursion, it is particularly important for the operator to plan the usage of the limited capacity for the power source to ensure that the batteries are not depleted while the marine vessel is away from shore and, more generally, while the marine vessel is unable to replenish the finite capacity power source.

Systems and methods presently known in the art provide for load shedding of devices based on a state of charge (SOC), voltage, amperes, or power consumption of primary or secondary systems. However, only a current status is provided to the operator, displaying the current draw of each device within the system, or drawn since the last recharging event. In certain examples, such may be provided with cellular phones, the percentage of battery usage consumed by each app may be displayed as a measure since the last time the phone was charged, for example. However, the inventors have recognized that these prior art systems are not effective for planning the overall consumption of power by devices over a period of time, such as an excursion. In the case of an excursion (e.g., planned usage with no additional power available), there is a risk of operators running out of power in an inopportune moment, leading to inconvenience and potentially danger. For example, power may be depleted such that electric motors are no longer operable before reaching the destination, and/or power for radio communications is not available in an emergency.

Figure 3:
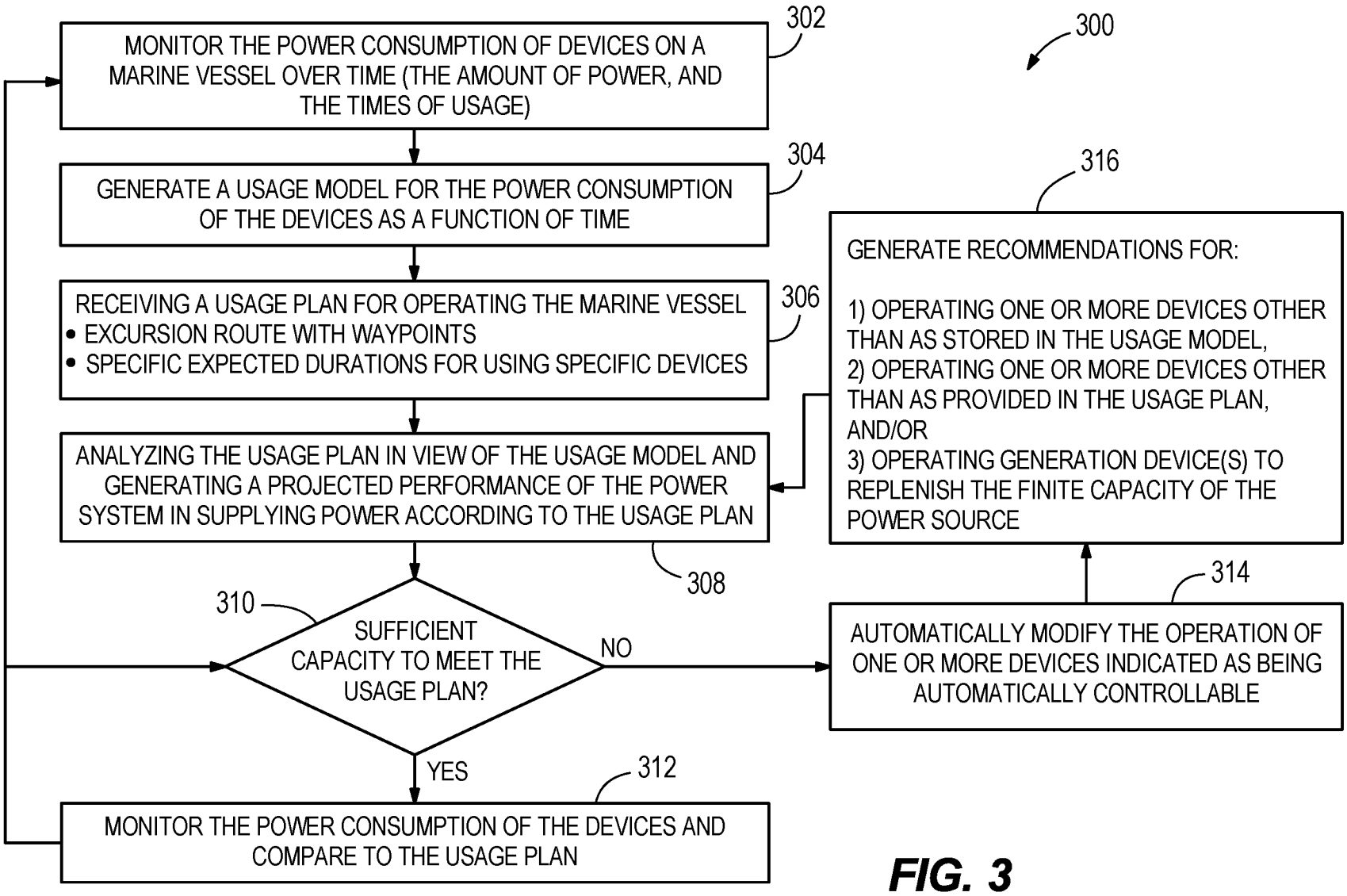
FIG. 3 depicts an exemplary method for planning consumption of power by devices aboard a marine vessel, such as that shown in FIG. 1.

FIG. 3 depicts an exemplary method 300 for planning consumption of power by devices 412 onboard a marine vessel from a power source 90 having a finite capacity. Step 302 provides for monitoring the power consumption of the devices 412 on the marine vessel over time, which may include the amount of power consumed by each device, the duration in which power is consumed, and/or the times of day in which power is consumed (and the rates at those times). This step may be performed by the user during a single calibration type setup, on a periodic basis, and/or include data provided from the factory for a given type of a marine vessel, in certain examples considering the particular devices 412 aboard that marine vessel. Step 302 takes place over a 24 hour period, a week, or a number of charge cycles, for example. This collected data is then used in step 304 to generate a usage model (stored within the data 124 of the memory system 120 discussed above) for the power consumption of the devices 412 as a function of time.

An exemplary usage model 400 is provided in FIG. 4, which in the present example includes a main usage table 410, usage by time table 420, and generation table 430. The main usage table 410 includes a listing of devices 412 that have recorded data over a time period. As discussed above, this time period may be 24 hours, several days, or other time periods, with the main usage table 410 presently showing exemplary data for a 24-hour period. The main usage table 410 further includes durations 414 of usage for each of the devices 412, as well as the total power used 416 and the power used as a percentage of capacity 418 for the power source 90. The present example shows the percentage capacity 418 assuming a 125 kWh power source capacity. In this example, device A (here, a water heater) was used for two hours and consumed four kWh of power during the 24-hour period, which constituted 3.2 percent of the percent capacity of the power source 90. It will be recognized that these values are merely exemplary and may also be updated over time, or taken as an average, for example, as the performance and need for each of the devices 412 will vary by usage of the marine vessel, time of day, and other environmental and other factors.

In certain embodiments, such as that shown in FIG. 4, a usage by time table 420 is also provided within the usage model 400. In the example shown, the usage by time table 420 is shown for device A, which in the present example is a water heater. The usage by time table 420 specifically provides that of the four kWh of total power used 416 as shown in the main usage table 410, the power used by time range 424 is broken down by time period 422. In this manner, it can be seen that two kWh of power was used in the period between 10:00 p.m. and 5:59 a.m., demonstrating a non-uniform usage of power by device A over the 24-hour time period.

In further embodiments the usage model 400 also includes a generation table 430, which in the example of a marine vessel includes any source of power generation other than a shore power connection. For example, the devices 432 provided in the generation table 430 include an engine alternator 27 (FIG. 1) and/or external generators 93, which may include additional fuel generators, wind turbine, and/or solar panel, for example. The generation table 430 further provides for the duration 434, power generation 436, and percent capacity 438 of the power source 90 in which each of the devices 432 generated power during the 24-hour time period. In this manner, the usage model 400 not only provides for the expected power consumption of each of the devices 412, but also specific times in which each of the devices is used, and also the rate by which the power source is regenerated by the generation devices 432 as provided in the generation table 430. In further examples a shore power connection may also be considered within the generation table 430, such as for a resource planning system 92 that also provides guidance for how long a marine vessel must remain docked before departing to ensure sufficient resources are available for the entire excursion, for example.

Returning to FIG. 3, the method continues by receiving in step 306 a usage plan for operating the marine vessel, such as a particular excursion or planned use between replenishment of the power source 90. The usage plan may be received via input devices 99 (FIG. 2) and stored within the data 124 of the memory system 120, for example. The usage plan may include an excursion route from a starting point to an ending point, potentially with waypoints along the way, which in certain examples is received in whole or part from a GPS or other navigation planning system, for example. The usage plan may also or alternatively include other expected usages of the limited capacity of the power source 90, such as expected durations for operating specific devices 412 aboard the marine vessel. For example, the operator may input a plan to use electric motors for four hours, operate a water maker for two hours, and run the air conditioning for ten hours.

Step 308 then provides for analyzing the usage plan received in step 306 in view of the usage model generated in step 304. The system, such as the resource planning system 92 of FIG. 1, then generates a projected performance of the power system 90 in supplying the necessary amount of power to fulfill the usage plan. In step 310, it is then determined whether there is sufficient capacity for the power source 90 to meet the usage plan received in step 306. Some amount of buffer may be included, such as to assume 20% less capacity than expected due to environmental changes, deterioration of batteries, and the like.

If it is determined in step 310 that there is sufficient capacity to meet the usage plan, the process continues with step 312 by monitoring the power consumption of the devices 412 and periodically comparing this power consumption to the usage plan. If instead it is determined in step 310 that there is not sufficient capacity of the power source 90 to meet the usage plan, warnings or other indications are provided to communicate to the operator that capacity is no longer sufficient, or is at risk of not being sufficient if power consumption is not modified. In certain examples, specific recommendations for modifying the consumption of power by particular devices may be provided by the operator, whether by the devices having the largest amount of consumption, and/or the devices deviating the most from the usage plan, for example.

In the embodiment shown in FIG. 3, determining in step 310 that there is not sufficient capacity of the power source 90 to meet the usage plan and results in automatically modifying the operation of one or more devices 412 in step 314. This automatic modification may be particularly for devices 412 previously indicated as permitting automatic control so as to not make modifications unacceptable to the operator. Step 314 may be particularly advantageous when the marine vessel is already underway, as the resource planning system 92 must ensure that sufficient capacity remains in the power source 90 to arrive at the final destination, rather than simply indicating that the usage plan is incompatible with the usage model and/or capacity of the power source 90.

In the exemplary method 300 shown, step 316 further provides for generating additional recommendations for reducing the power consumption of devices 412, and/or generating additional power via generation devices 432 as previously discussed. In the example shown, step 316 is provided in addition to step 314, although it should be recognized that the method may include either one of these independently as well. In the example shown, step 316 particularly provides recommendations for: 1) operating one or more devices 412 other than as stored in the usage model of step 304; 2) operating one or more devices 412 other than as provided in the usage plan of step 306; and/or 3) operating the generation devices 432 to replenish the finite capacity of the power source 90, thereby increasing the ability of the system to accommodate the usage plan provided in step 306.

An exemplary case of using the resource planning system 92 is now provided, for example using the method 300 of FIG. 3. During a day trip, when the operator returns to show and reconnects to shore power, the power system 90 has 20% remaining state of charge (SOC). Upon viewing the data provided within the resource planning system 92 as described above, the operator sees that the water heater was on for 1.5 hours and consumed 12.8% of the total SOC. Additionally, indirect lighting (e.g., accent lighting) was used for six hours and consumed 7.1% of the total SOC. The resource planning system 92 then provides, such as on a conventional display device 34 (FIG. 1) that if the operator wishes to remain away from shore for a longer time period yet return with 20% SOC remaining (e.g., via the inputting of a usage plan), a plan will need to be made to consume less energy. The resource planning system 92 also displays, and/or enables the operator to determine that based on the power used by time table 420, accent lighting was in use even after the sun rose, thereby essentially just wasting power, but being difficult to detect in the daylight. Based on this information, the resource planning system 92 either automatically adjusts the accent lighting usage for the future, recommends this action, and/or enables the operator to quickly make this determination. Furthermore, it can quickly be seen what savings would occur by disabling the accent lighting at a certain time, for example 7:30 am, which may provide a savings of 5.3 of total SOC.

The inventors have further recognized that certain embodiments may be further improved by the incorporation of machine learning or artificial intelligence. For example, the resource planning system 92 may make automatic adjustments and/or recommendations based on the power usage from previous trips. In addition, the resource planning system 92 may learn over time that particular portions of a trip require more or less power than others, for example going with, against, or across currents in the case of an electric motor, and adjust the predicted power usage accordingly. Likewise, the operating performance of batteries 91 or devices 412, for example, may vary by time of year or time of day (e.g., due to temperatures), which may be learned over time to improve the accuracy of the resource planning system 92.

The functional block diagrams, operational sequences, and flow diagrams provided in the Figures are representative of exemplary architectures, environments, and methodologies for performing novel aspects of the disclosure. While, for purposes of simplicity of explanation, the methodologies included herein may be in the form of a functional diagram, operational sequence, or flow diagram, and may be described as a series of acts, it is to be understood and appreciated that the methodologies are not limited by the order of acts, as some acts may, in accordance therewith, occur in a different order and/or concurrently with other acts from that shown and described herein. For example, those skilled in the art will understand and appreciate that a methodology can alternatively be represented as a series of interrelated states or events, such as in a state diagram. Moreover, not all acts illustrated in a methodology may be required for a novel implementation.

This written description uses examples to disclose the invention, including the best mode, and also to enable any person skilled in the art to make and use the invention. Certain terms have been used for brevity, clarity, and understanding. No unnecessary limitations are to be inferred therefrom beyond the requirement of the prior art because such terms are used for descriptive purposes only and are intended to be broadly construed. The patentable scope of the invention is defined by the claims and may include other examples that occur to those skilled in the art. Such other examples are intended to be within the scope of the claims if they have features or structural elements that do not differ from the literal language of the claims, or if they include equivalent features or structural elements with insubstantial differences from the literal languages of the claims.

What is claimed is:

1. A method for planning consumption of power by devices onboard a marine vessel from an electrical energy storage device having a finite capacity not replenished by a fuel-based generator during a planned excursion, the marine vessel comprising devices including a propulsion device operable to propel the marine vessel in water and a nonpropulsion device operable other than to propel the marine vessel in the water, the method comprising:

storing a usage model within a memory system, wherein the usage model includes an amount and a duration of the power consumed by each of the devices over a previous time period;

receiving from a user, prior to the planned excursion, a usage plan of the user's intentions for operating the marine vessel during the planned excursion while the electrical energy storage device is limited to the finite capacity, the usage plan including expected durations for consuming power with at least a portion of the devices;

prior to operating the marine vessel according to the usage plan, analyzing with a control system the usage plan in view of the usage model and generating a projected performance of the electrical energy storage device, wherein the projected performance indicates whether the electrical energy storage device can supply the power needed by the devices while operating the marine vessel according to the usage plan without depleting the electrical energy storage device;

determining, based on the projected performance, that operating the marine vessel according to the usage plan would deplete the finite capacity of the electrical energy storage device before completion of the planned excursion; and in response to the determining that the usage plan would deplete the finite capacity, generating a recommendation for changing whether to operate, a power consumed to operate, and/or for how long to operate the non-propulsion device and/or automatically modifying whether to operate, a power consumed to operate, and/or for how long to operate the non-propulsion device based on the projected performance prior to operating the marine vessel according to the usage plan, differently than as stored within the usage model and/or as received in the usage plan, to reduce the power consumed from the finite capacity by at least the non-propulsion device so the finite capacity of the electrical energy storage device is sufficient for powering another device among the devices without additional power input, without altering a route or speed of the propulsion device.

2. The method according to claim 1, wherein the usage plan includes a route for navigating the marine vessel.

3. The method according to claim 1, wherein the electrical energy storage device comprises one or more batteries and the previous time period is an elapsed time between charging the one or more batteries.

4. The method according to claim 1, further comprising updating the usage model based on the amount of the power consumed by each of the devices over additional time periods.

5. The method according to claim 1, wherein the usage model further includes the amount of the power consumed by each of the devices by a time of day.

6. The method according to claim 5, further comprising generating recommendations for modifying the power consumed by one or more of the devices by the time of day.

7. The method according to claim 1, further comprising determining an actual consumption of the power by each of the devices as the marine vessel is operated, and repeating the steps of analyzing the usage plan in view of the usage model and generating the projected performance of the electrical energy storage device based on the actual consumption determined.

8. The method according to claim 7, further comprising determining the actual consumption of the power by each of the devices, analyzing the usage plan, and generating the projected performance on a periodic basis.

9. The method according to claim 1, further comprising determining a recharging rate of a power generation source replenishing the finite capacity of the electrical energy storage device, and further comprising incorporating the recharging rate into the projected performance generated by the control system.

10. The method according to claim 1, further comprising incorporating within the usage model a recharging rate of a power generation source for replenishing the finite capacity of the electrical energy storage device, and further comprising generating recommendations for operating the power generation source.

11. The method according to claim 10, wherein the power generation source is at least one of an engine having an alternator, an external generator, a wind turbine, and a solar panel.

12. A method for planning consumption of power by devices onboard a marine vessel from an electrical energy storage device having a finite capacity not replenished by a fuel-based generator during a planned excursion, the devices comprising a non-propulsion device operable other than to propel the marine vessel in water, and the marine vessel comprising a propulsion device operable to propel the marine vessel in the water, the method comprising:

storing in a memory system a usage model that includes an amount and a duration of the power consumed by at least the non-propulsion device over a previous time period;

receiving from a user, prior to operating the marine vessel during a subsequent time period after the previous time period and after the finite capacity of the electrical energy storage device has been restored, a usage plan of the user's intentions for operating the marine vessel during the planned excursion, the usage plan including expected durations for consuming power with the non-propulsion device while the electrical energy storage device is limited to the finite capacity not replenished by the fuel-based generator;

prior to operating the marine vessel according to the usage plan, generating with a control system, based on the usage model, a projected performance indicating whether the electrical energy storage device can supply the power needed by the devices when operated according to the usage plan without depleting the electrical energy storage device;

determining, based on the projected performance, that operating the marine vessel according to the usage plan would deplete the finite capacity of the electrical energy storage device before completion of the planned excursion; and in response to the determining that the usage plan would deplete the finite capacity, generating a recommendation for changing whether to operate, a power consumed to operate, and/or for how long to operate the non-propulsion device and/or automatically modifying whether to operate, a power consumed to operate, and/or for how long to operate the non-propulsion device based on the projected performance prior to operating the marine vessel according to the usage plan, differently than as stored within the usage model and/or as received in the usage plan, so the finite capacity of the electrical energy storage device is sufficient for powering another device among the devices without additional power input, without altering a route or speed of the propulsion device.

13. The method according to claim 12, wherein the previous time period includes multiple cycles of restoring the finite capacity of the electrical energy storage device, and wherein the amounts of the power stored in the usage model are provided as averages over those multiple cycles of restoring the finite capacity.

14. The method according to claim 12, further comprising configuring updating the usage model based on the amount of the power consumed by each of the devices over time, further comprising providing an indication when the amount of the power consumed by one of the devices changes in excess of a threshold amount over time.

15. The method according to claim 12, wherein the usage model further includes the amount of the power consumed by each of the devices by a time of day.

16. The method according to claim 12, wherein the projected performance includes a duration in which the devices may be operated according to the usage model before the finite capacity of the electrical energy storage device reaches a depletion threshold.

17. The method according to claim 1, wherein the usage plan is received from the user via at least one input device at a helm of the marine vessel.

18. The method according to claim 1, wherein the finite capacity of the electrical energy storage device comprises electrical power stored in batteries for powering the devices onboard the marine vessel.

19. The method according to claim 18, wherein the recommendation for operating one of the devices and/or automatically modified operation of one of the devices is generated to reduce the power to be consumed by the one of the devices in comparison to the usage plan of the one of the devices from the user.

* * * * *